US007021099B2

(12) United States Patent
Bennett et al.

(10) Patent No.: US 7,021,099 B2
(45) Date of Patent: Apr. 4, 2006

(54) EXTRACTION SYSTEM FOR HOT FORMED PARTS

(75) Inventors: Edward W. Bennett, Clarkston, MI (US); Leonard L. Pollum, Lapeer, MI (US); Gary A. Kruger, Troy, MI (US)

(73) Assignee: General Motors Corporation, Detroit, MI (US)

( * ) Notice: Subject to any disclaimer, the term of this patent is extended or adjusted under 35 U.S.C. 154(b) by 246 days.

(21) Appl. No.: 10/460,056

(22) Filed: Jun. 12, 2003

(65) Prior Publication Data

US 2004/0250585 A1 Dec. 16, 2004

(51) Int. Cl.
*B21D 45/02* (2006.01)
*B21D 26/02* (2006.01)

(52) U.S. Cl. ..... 72/57; 72/60; 72/344; 72/427

(58) Field of Classification Search ..... 72/344, 72/427, 62, 60, 59, 58, 57, 55
See application file for complete search history.

(56) References Cited

U.S. PATENT DOCUMENTS

| | | | | |
|---|---|---|---|---|
| 4,741,197 | A * | 5/1988 | Spuhler et al. | 72/427 |
| 4,956,008 | A * | 9/1990 | McQuilkin | 72/427 |
| 5,747,179 | A * | 5/1998 | Matsen et al. | 72/60 |
| 6,206,682 | B1 | 3/2001 | Vovan | 425/556 |
| 6,253,588 | B1 * | 7/2001 | Rashid et al. | 72/57 |
| 6,615,631 | B1 | 9/2003 | Kleber et al. | 72/60 |
| 6,686,383 | B1 | 2/2004 | Nishikawa et al. | 514/381 |
| 6,843,088 | B1 * | 1/2005 | Kruger et al. | 72/57 |

* cited by examiner

*Primary Examiner*—David Jones
(74) *Attorney, Agent, or Firm*—Kathryn A. Marra

(57) ABSTRACT

The distortion-free removal of a heat softened sheet metal part from a heated forming surface is enabled by the elevation of lift pads in the forming surface. Strategically located and sized pads are recessed in the forming surface of the hot forming tool and the pads are part of the forming surface. At the completion of the stretch forming, or other hot forming, of a sheet metal blank on the forming surface, the pads are lifted in unison, without rotating them, on lift posts by a suitable lift mechanism to carefully and uniformly strip the flexible part from the hot forming surface.

8 Claims, 2 Drawing Sheets

EXTRACTION SYSTEM FOR HOT FORMED PARTS

TECHNICAL FIELD

This invention pertains to equipment for hot stretch forming of sheet metal blanks. More specifically this invention pertains to an extraction mechanism for removal of a formed, heat softened, sheet metal workpiece from the hot forming tool without distortion of the part.

BACKGROUND OF THE INVENTION

Some sheet metal parts are formed at elevated temperatures. When appropriately heated the sheet metal workpiece is more ductile and can be stretched without tearing or wrinkling into more complex shapes than can be obtained by stamping at ambient temperature. For example, a sheet metal blank is heated to a stretch forming or blow forming temperature, depending upon the alloy composition and microstructure, and gas pressure is applied to one side of the blank to stretch the blank and force the other side into conformity with the forming surface of a suitable tool.

In one example of elevated temperature sheet metal forming processes, automotive body panel and other sheet metal parts of complex shape are formed from aluminum alloys of superplastically or quick plastically formable composition and metallurgical microstructure. U.S. Pat. No. 6,253,588, entitled "Quick Plastic Forming of Aluminum Alloy Sheet Metal" to Rashid et al, and assigned to the assignee of this invention, describes the forming of some aluminum alloys at high strain rates in the temperature range of, e.g., 825 F to 875 F.

Thus, at the completion of the sheet metal forming step a thin, hot, intricately shaped part must be separated from a hot forming tool without distorting or marring the workpiece. The forming tool is typically carried in a two-part press structure which is opened for removal of the part. The part might be cooled in the opened press before removal from the tool, but such a delay lengthens the manufacturing cycle and is a non-productive use of expensive equipment. Means must be found to carefully remove the soft sheet metal part from the tool for cooling and subsequent trimming or other finishing operation. It is an object of this invention to provide an apparatus associated with the forming tool for accomplishing this task.

SUMMARY OF THE INVENTION

The stretch forming of a heat softened sheet metal blank is usually accomplished using one or more hot forming tools, for example, a preform tool and a finish form tool. The tool is often supported on a two part press that is movable from an open position for robotic placement of a preheated sheet. When the press is closed the sheet is gripped near its edges between the forming tool with its part shaping surface on one side of the sheet and an opposing tool that defines a closed working gas chamber on the other side of the sheet. A pressurized working gas is applied to the hot sheet to gradually stretch it against the shaping or forming surface of the forming tool and into conformance with that surface. The tools are also heated for the forming operation, sometimes by heating elements in the platens of the press and sometimes by heating elements in the tools. The part removal apparatus of this invention is best used with forming tools having integral heating elements.

The forming tool is usually made from a block of metal such as a tool steel. One surface of the block is carefully machined as the sheet metal forming surface. Holes are bored in the block for insertion of electrical resistance heating elements or other suitable heating means. Preferably, the sides and bottom of the block are covered with suitable thermal insulation to minimize heat loss from the tool to the press and to the portion of the part removal apparatus that is outside the tool block.

In accordance with this invention, metal pads are placed in suitable cavities machined in the forming surface of the tool for pushing and separating the heat softened, formed sheet metal part from the hot tool surface. The shape of the cavities conform to the cross-sections of the respective pads although the pads are not necessarily of the same shape. The pads are positioned around the forming surface and sized and shaped for uniform and distortion-free raising of the part from the tool. The surfaces of the pads conform to the surrounding forming surface and, indeed, are part of it during the forming of the sheet blank. The pads are attached to the ends of lift posts that extend from the underlying surfaces of the pads through the tool block and the insulation layer on the bottom of the block (or side of the block, if necessary). The bottom ends of the lift posts from the many pads bear on a lift plate which is typically below the tool and the insulation layer covering its bottom side.

When the part has been formed on the tool forming surface and it is time to strip it from the tool surface, a suitable mechanism is employed to uniformly raise the lift plate a suitable distance for the pads to separate the part from the tool for removal from the tool and the press by robotic or other suitable material handling means. The lifting mechanism is preferably outside of the heated tool, such as below it, and somewhat insulated from its heat. The lifting mechanism may include, for example, an electric motor driven, or air motor driven, mechanism or hydraulic cylinders or a pneumatically driven lift rack and pinion system. The lifting mechanism is operated when the press is opened for removal of then part.

The pads permit careful, uniform and distortion- or damage-free separation of the hot part from the tool surface and safe removal to a suitable cooling rack before further processing of the formed part. Each pad is shaped to act on the overlying portion of the part. Preferably, the pads are generally square or rectangular in plan view and are recessed into like shaped cavities in the forming tool surface. The thickness of the pads is such that they don't have to be full elevated out of their respective cavities during part removal. In this way the pads don't rotate during part removal and shift out of conformance with the surrounding forming surfaces.

Other objects and advantages of the invention will become clearer from a detailed description of a preferred embodiment of the invention which follows.

DESCRIPTION OF A PREFERRED EMBODIMENT

In hot stretch forming of a sheet metal part, which is typically only about one to about four millimeters in thickness, the designer of manufacturing equipment and tooling must give careful attention to the forming surface of the tool, the lifting of the heat softened, formed part from the surface of the tool and the transport of the hot part to a cooling rack or fixture. While each of these matters is important to obtaining and maintaining the desired shape of the part, the focus in this invention is on the careful separation of the part from the hot tool surface.

Figure 1:
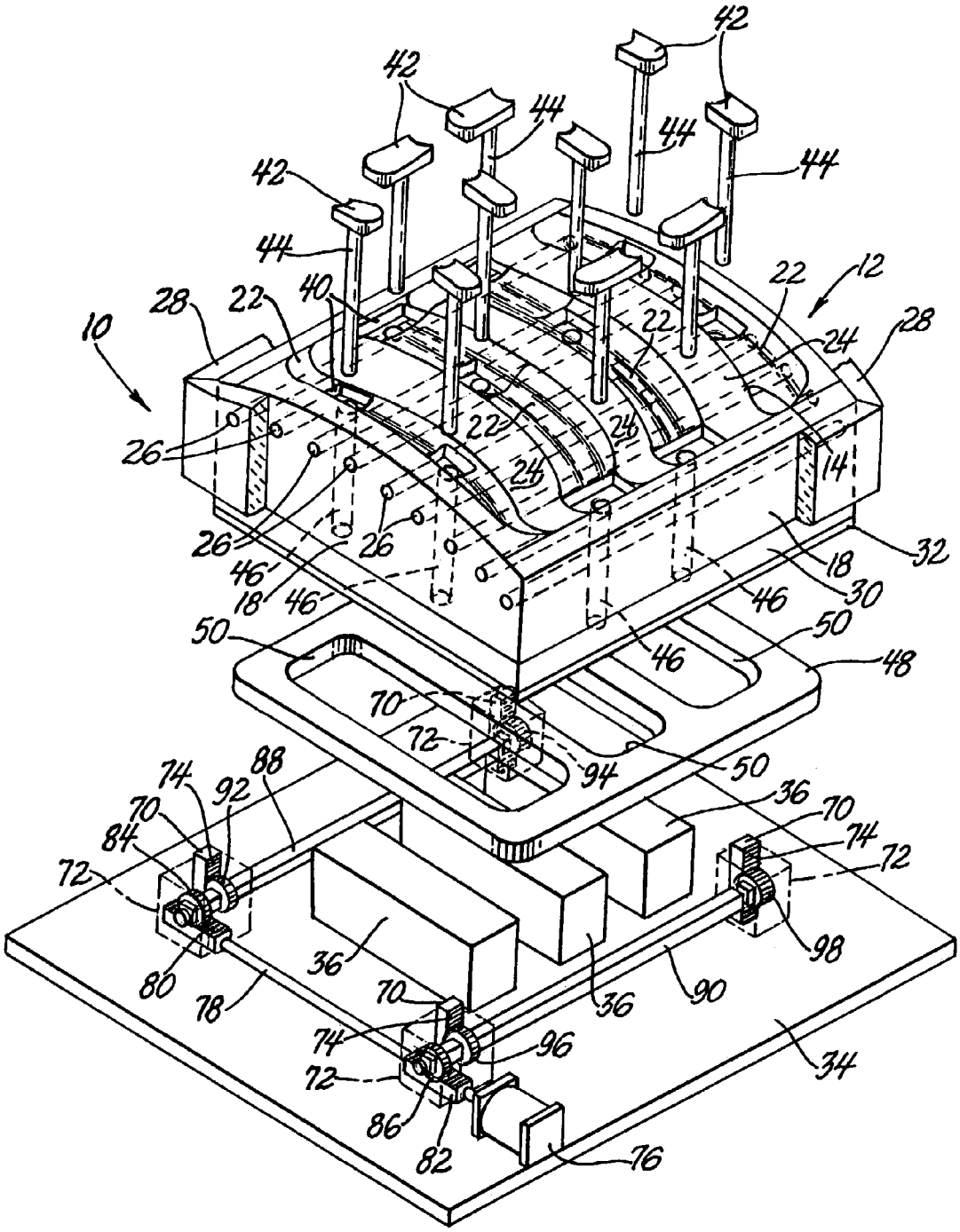
FIG. 1 is an oblique exploded side view of a hot sheet metal forming tool with an extractor mechanism of this invention.

FIG. 1 illustrates an assembly 10 of a part forming tool-part removal apparatus for the stretch forming of a sheet metal blank at an elevated temperature. By way of example, the specific workpiece may be a fine grained, high elongation AA5083 magnesium containing, aluminum alloy sheet, 1.5 mm thick which will be preheated to about 500° C. and formed on a tool surface maintained at about that temperature. The forming tool is typically machined from a block of cast metal such as a tool steel.

In FIG. 1, forming tool 12 is approximately square in plan view and has a machined upper forming surface 14 for the forming of a sheet metal part. The tool further has four vertical sides 18 and a flat bottom 20 (which is better seen in FIGS. 2A and 2B). In FIG. 1, forming surface 14 comprises four parallel valleys 22 that run from one side of the tool to the other. Forming surface valleys 22 are separated by three ridges 24.

Forming tool 12 includes several electrical resistance heating rods 26 that are inserted through bores in the tool 12 from one vertical sidewall 18 to the opposing vertical sidewall 18. These electrical resistance heaters are connected to electrical power delivery system and control system (neither shown) for maintaining tool 12 and particularly forming surface 14 at a temperature suitable for the forming of the sheet metal workpiece.

In FIG. 1, each side 18 of the metal tool 12 is covered with a block of insulation material 28 to reduce the temperature at the outside of the insulation to a level below that of the body of the tool 12. Side insulation blocks 28 are shown only as broken off portions on the four sides of FIG. 1 for purposes of simplifying the illustration. They are not shown in FIGS. 2A and 2B for the same reason. At the bottom of the tool 12 is another insulation block 30. Below bottom insulation block 30 is a steel support plate 32 for support of tool 12 typically on the lower platen 34 of a suitable press (not shown). In this instance, lower support plate 32 is supported on three blocks 36 which in turn lie on lower platen 34 of a press.

Thus, forming tool 12 is internally heated by electrical resistance heating rods 26 and thermally insulated by blocks 28, 30 to reduce heat loss from the tool 12.

The forming surface 14 of tool 12 illustrated in the drawing figures is quite contoured for purposes of illustration of the practice of this invention. The wavy contours extend across the width of the tool 12 and as stated include four parallel valleys 22 separated by three parallel ridges 24. The forming surface 14 is carefully machined from the tool steel block that forms the tool 12. However, ten generally rectangular cavities 40 are machined from forming surface 14 to closely receive ten metal support pads 42, each pad being of substantially the same cross-section and thickness as its corresponding cavity. Preferably, pads 42 are made of the same tool steel or material of the forming tool 12. In this example, cavities 40 are located in valleys 22 of tool surface 14.

Pads 42 are each attached to an end of a round lift post 44. Each lift post 44 fits in a lift post bore hole 46 in tool 12 and extends from a cavity 40 down through the bottom 20 of the tool 12 and through the lower insulation block 30 and support plate 32. The lower ends of the posts 44 rest on a lift plate 48. Lift plate 48 is a steel plate for raising lift posts 44 in their respective bore holes 46. Lift plate 48 has three slots 50 so that plate 48 can fit around support blocks 36 for the forming tool 12. Support blocks 36 are provided with optional passages 102, FIGS. 2A and 2B, for cooling water from a source not shown in the event that cooling is required for operation of the lift mechanism to be described. Lift plate 48 may also be provided with coolant passages 104.

The shape of each pad 42 is an important feature of this invention. The upper surface of each pad 42 acts as part of the forming surface 14 of tool 12 during the forming of a workpiece. Thus, the surface of each pad 42 is shaped to conform to the surrounding region of the forming surface 14 in which the pad is located. The surface area of each pad 42 is large enough to lift a heat softened formed metal sheet from contact with the tool without deforming or damaging the hot formed part. In general, it is preferred that pads 42 be non-circular in plan view. Suitably they are square or rectangular so that they do not rotate when they are lifting a part from the forming surface 14 of tool 12 as will be described below. Each pad is shaped for its own location and they do not have to have the same cross-section.

The operation of the apparatus of this invention will be further described with reference to FIGS. 2A and 2B as well as to FIG. 1.

In a representative stretch forming operation of a heated sheet metal workpiece it is common to use two opposing tools to provide a forming surface for the sheet metal blank and to define a chamber for the application of high pressure gas to stretch the sheet into conformance with the forming surface. This arrangement is illustrated in FIGS. 2A and 2B.

Figure 2A:
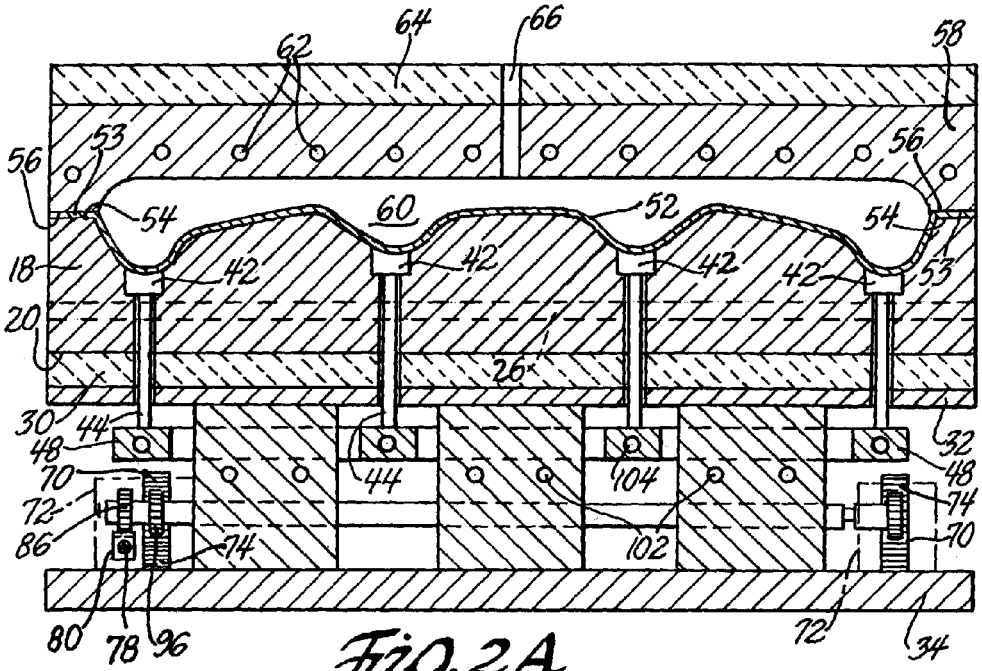
FIG. 2A is a sectional view of the forming tool and extractor mechanism of FIG. 1 plus a complementary pressure chamber tool for the forming operation.

FIG. 2A shows the forming tool 12 of FIG. 1 in cross-section with four pads 42 seen in this staggered cross-section in their recessed position (in recesses 40) within the body of the forming tool 12. Lift posts 44 are seen to extend vertically downward through the forming tool block, through bottom insulation layer 30 and metal plate support plate 32 with their ends resting on lift plate 48. The tool itself is resting on the blocks that support it above the press platen. A representative electrical resistance heating rod 26 is seen traversing the width of the tool 12.

The sheet metal blank 52 is shown with its edges 53 gripped between the periphery 54 of forming tool 12 and the periphery 56 of an upper tool 58. Upper tool 58 cooperates with forming tool 12 and blank 52 to define a gas pressure chamber 60 above the blank 52. Upper tool 58 is heated with electrical resistance heating rods 62. Insulation layer 64 on the top surface of tool 58 thermally insulates it from upper press platen, not shown. As shown in FIGS. 2A and 2B, tubular passage 66 through upper tool 58 and insulation layer 64 provides for the admission of high pressure working gas such as nitrogen or air into chamber 60 for the stretch forming of heat softened sheet metal blank 52.

At the stage of operation illustrated in FIG. 2A, working gas pressure has been applied against the upper side of blank 52. Blank 52 gripped at its edges between the cooperating tools 12, 58 has been stretched into the valley 22 and ridge 24 conformation of forming surface 14 of tool 12. Pads 42 each constitute a portion of the valley regions 22 of forming surface 14.

Figure 2B:
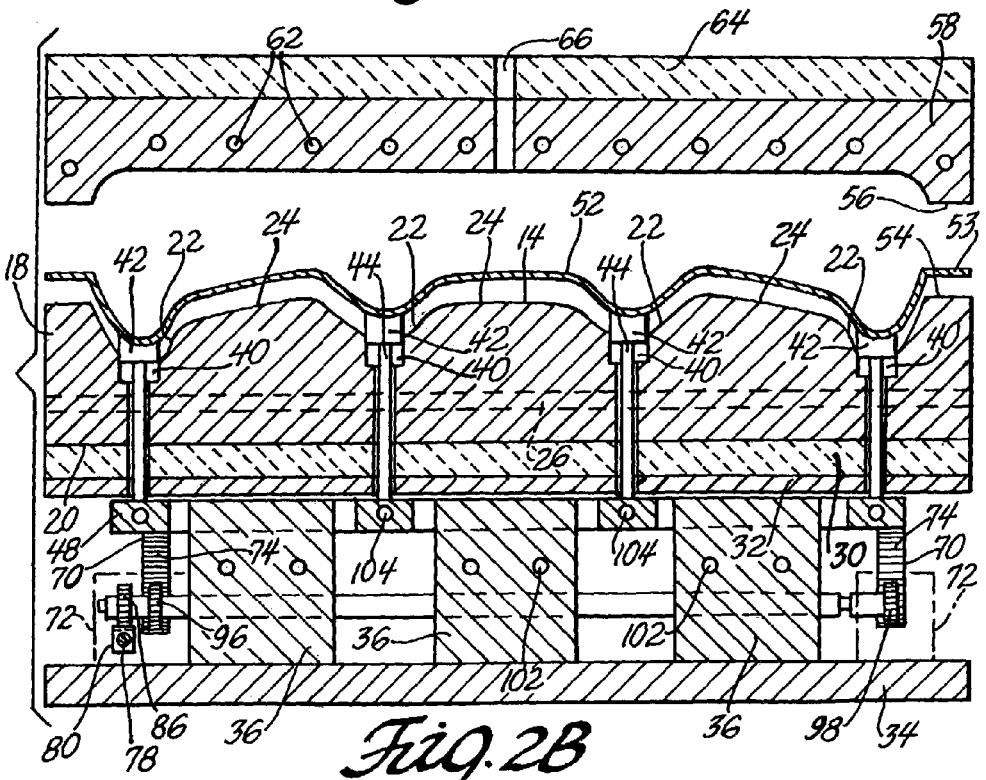
FIG. 2B is a sectional view like FIG. 2A with the forming tool and the pressure chamber defining tool in the open position and the extractor mechanism having separated the formed part from the forming tool.

At the stage of operation illustrated in FIG. 2B the working gas has been vented through passage 66 from pressure chamber 60. Upper tool 58 has been raised by press operation for removal of the formed sheet metal part 52. A suitable lift mechanism (described below) is actuated to uniformly raise lift plate 48 from its horizontal rest position (a lowered position as shown in FIG. 2A) during workpiece forming. The elevation of lift plate 48 raises lift posts 44 in unison to lift pads 42 in unison to carefully strip the formed sheet metal part 52 from the surface 14 of forming tool 12. As illustrated in FIG. 2B, the four pads 42 visible in this cross-section (of ten in this embodiment) have been elevated in recesses 40 (but not completely out of the recesses) to uniformly strip formed part 52, without deforming it, from forming surface 14. Formed part 52 is lifted sufficient distance (for example, one-half inch to two inches) for robotic arms not shown, to grasp the corners of the part and remove it from the open press to a cooling fixture preparatory for trimming and other finish operations on the formed sheet metal part.

It is expected that many extraction pads will engage the workpiece in regions that will be retained in the final part. Of course, some may also be located to engage a workpiece in a region that will be trimmed as offal. In FIGS. 2A and 2B, pads 42 are contacting portions of the workpiece that would be part of the finished part. In this example, the four illustrated pads 42 are placed at the bottom of valleys 22 in the forming surface 14 of the tool. In this location the pads will push against a rounded portion of the formed part with immediately adjacent rising vertical surfaces that can release more easily from that portion of the forming surface. These are an example of a strategic desirable place to lift a heat softened workpiece without deforming it.

As stated it is preferred to lift the extraction pads 42 simultaneously and uniformly. Referring to the drawing figures, horizontal lift plate 48 is supported at its four corners by four square vertical lift plate posts 70 each confined within a support member 72 (shown in outline). One side 74 of each vertical lift plate post 70 is provided with a rising pattern of parallel threads. A mechanism is employed to raise each vertical lift plate post 70 at the same time by the same amount to lift and maintain the horizontal attitude of lift plate 48. The mechanism is carried on platen 34

When it is time to strip formed part 52 from forming surface 14, a pneumatic cylinder 76 is actuated by compressed air (from a standard source, not shown). A piston (not shown) within cylinder 76 drives push rod 78 (see FIG. 1) with worm gear sections 80, 82. The advancement of push rod 78 turns two pinion gears 84, 86. Gear 84 is keyed to shaft 88 mounted on the support members 72 at the rear of the tool assembly as viewed in FIG. 1. Pinion gear 86 is keyed to shaft 90 similarly mounted on support members 72 at the front of the assembly 10. Rotation of pinion gears 84, 86 rotates shafts 88, 90. Shaft 88 carries pinions 92, 94 for elevating the rearward lift plate posts 70 and shaft 90 carries pinions 96, 98 for elevating the front side lift plate posts 70. This pneumatically actuated mechanism is constructed to raise lift plate 48 uniformly so that each of the lift pads 42 acts in unison on the part 52 for uniform stripping of the part from the tool surface 14.

As seen in FIG. 2B, the pads 42 have lifted workpiece 52 from forming surface 14. However, the pads 42 are sufficiently thick that they haven't completely cleared their respective cavities 40. Contacts between cavities 40 and pads 42 prevent rotation of the pads 42 from conformity with their respective surrounding forming surfaces.

In this embodiment, when the formed part 52 has been remeoved from the press, air pressure is released from cylinder 76 (or the action of the cylinder is reversed) and the lift plate 48, lift posts 44 and pads 42 drop down to their positions for blank forming as seen in FIG. 2A.

The lifting of lift plate 48 and the pad lift posts 44 that bear on it can be accomplished by any suitable power system. The pad lift mechanism may be actuated by hydraulic power or electric motors and the like instead of the pneumatic system. Alternatively, a separately energized lifting means can be located at each corner or selected lifting location of lift plate 48.

The strategy of the invention is to provide pads of suitable size and shape, located more or less uniformly across the plan view of the formed part, so as to uniformly strip the part from the tool as has been described. In one example of forming an automotive vehicle liftgate panel, a suitable forming tool was developed in which the total contact surface of the lift pads represented about 1.5 percent of the sheet metal contact area of the tool. Thus, in body panel forming of present level of shape complexity, total pad areas of about one to three percent of the tool to part contact area may be expected. Obviously, different part configurations will require different arrangements of extraction pad contact surface configurations and different total extraction pad areas. The requirements for pad contact for the removal of a heat softened part from a tool surface depends on the shape of the surface and the temperature and flexibility of the part at the time of its removal from the tool. In part to tool contacts where substantial areas of the part are slid off the tool (i.e., removed with a shearing like movement) less extractor pad area may be needed.

This invention has found particular use in the stretch forming of magnesium containing aluminum alloys of very high elongation that are shaped into automotive body panels. However, it is apparent that the extractor mechanism can be used in connection with the forming of heat softened sheet metal parts of any composition typically such parts are formed form suitable carbon steel alloys, other ferrous metal alloys, aluminum alloys, magnesium alloys and the like.

Accordingly, while the invention has been described in terms of a preferred embodiment, it will be appreciated that other forms could readily be adapted by ones skilled in the art. Accordingly, the scope of the invention is to be considered to be limited only by the scope of the following claims.

What is claimed is:

1. A forming tool for hot stretch forming of a heat softened sheet metal workpiece, the tool comprising:

a solid metal body with a forming surface for the workpiece, the solid metal body having sides at the periphery of the forming surface, and a bottom opposite the forming surface;

heating elements in the metal body for heating the body and forming surface to a hot forming temperature for the workpiece;

pads carried on lift posts, the pads being positioned in the forming surface and having pad surfaces conforming with the forming surface to participate in the hot forming of the workpiece, the pad surfaces being movable away from the forming surface for separating the formed workpiece from the forming surface and tool, the lift posts extending from the pads through the metal body and its bottom;

thermal insulation on the sides and bottom of the metal body, the lift posts extending through the insulation on the bottom of the metal body; and a lift plate adjacent the insulation on the bottom of the metal body for lifting the lift posts and pads in unison for raising the formed workpiece from the forming surface.

2. The forming tool recited in claim 1 in which the pads are positioned in the forming surface, and the pad surfaces are sized, for lifting the heat softened, formed workpiece without distortion of the workpiece.

3. The forming tool recited in claim 1 in which each pad surface conforms in surface configuration with the adjacent forming surface for forming and raising of the workpiece without distortion of the workpiece.

4. The forming tool as recited in claim 1 comprising means for moving said lift plate for the lift posts for separating the formed metal workpiece from the forming surface.

5. A forming tool for hot stretch forming of a heat softened sheet metal workpiece, the tool comprising:

a solid metal body with a forming surface for the workpiece, the solid metal body having sides at the periphery of the forming surface, and a bottom opposite the forming surface;

heating elements in the metal body for heating the body and forming surface to a hot forming temperature for the workpiece;

pads carried on lift posts, the pads being positioned during sheet forming in pad receiving and conforming cavities in the forming surface and having pad surfaces conforming with the forming surface to participate in the hot forming of the workpiece, the pads being movable to raise the pad surfaces out of the forming surface for separating the formed workpiece from the forming surface and tool, the lift posts extending from the pads through the metal body and its bottom;

thermal insulation on the sides and bottom of the metal body, the lift posts extending through the insulation on the bottom of the metal body; and a lift plate adjacent the insulation on the bottom of the metal body for lifting the lift posts and pads in unison for raising the formed workpiece from the forming surface.

6. The forming tool as recited in claim 5 in which the thickness of the pads is such that they are movable to separate the formed workpiece from the forming surface and the tool without the pads completely leaving the pad receiving and forming cavities.

7. The forming tool as recited in claim 6 in which the pads are non-circular in plan view such that they do not rotate while separating the formed workpiece from the forming surface and tool.

8. The forming tool as recited in claim 1 in which the pads are rectangular in plan view.

* * * * *